US009045958B2

(12) United States Patent
Eddison

(10) Patent No.: US 9,045,958 B2
(45) Date of Patent: Jun. 2, 2015

(54) TUBULAR RETRIEVAL

(75) Inventor: Alan Martyn Eddison, York (GB)

(73) Assignee: National Oilwell Varco, L.P., Houston, TX (US)

( * ) Notice: Subject to any disclaimer, the term of this patent is extended or adjusted under 35 U.S.C. 154(b) by 285 days.

(21) Appl. No.: 13/510,909

(22) PCT Filed: Nov. 19, 2010

(86) PCT No.: PCT/GB2010/002140

§ 371 (c)(1),
(2), (4) Date: May 18, 2012

(87) PCT Pub. No.: WO2011/061506

PCT Pub. Date: May 26, 2011

(65) Prior Publication Data

US 2012/0312549 A1 Dec. 13, 2012

(30) Foreign Application Priority Data

Nov. 20, 2009 (GB) ..... 0920346.4

(51) Int. Cl.

| | |
|---|---|
| ***E21B 31/12*** | (2006.01) |
| ***E21B 31/03*** | (2006.01) |
| ***E21B 29/00*** | (2006.01) |
| ***E21B 31/00*** | (2006.01) |

(52) U.S. Cl.
CPC ..... *E21B 31/03* (2013.01); *E21B 29/00* (2013.01); *E21B 31/005* (2013.01)

(58) Field of Classification Search
CPC ... E21B 31/005; E21B 31/1135; E21B 31/18; E21B 31/20
USPC ..... 166/301, 98, 99, 178, 177.6, 177.7, 166/177.1, 55, 361, 177.2
See application file for complete search history.

(56) References Cited

U.S. PATENT DOCUMENTS

| | | | | |
|---|---|---|---|---|
| 1,645,010 | A * | 10/1927 | Kinley | 166/215 |
| 2,901,044 | A * | 8/1959 | Arnold | 166/98 |
| 2,961,048 | A * | 11/1960 | Davis, Sr. | 173/129 |
| 2,972,380 | A * | 2/1961 | Bodine, Jr. | 166/301 |
| 3,213,941 | A | 10/1965 | Nelson | |
| 3,217,803 | A * | 11/1965 | Winger | 166/301 |
| 4,058,163 | A * | 11/1977 | Yandell | 166/177.6 |
| 4,236,580 | A * | 12/1980 | Bodine | 166/301 |
| 4,667,742 | A * | 5/1987 | Bodine | 166/301 |
| 4,673,037 | A * | 6/1987 | Bodine | 166/249 |
| 5,190,114 | A | 3/1993 | Walter | |
| 5,836,389 | A * | 11/1998 | Wagner et al. | 166/249 |
| 6,009,948 | A * | 1/2000 | Flanders et al. | 166/301 |
| 6,206,101 | B1 * | 3/2001 | Bakke | 166/301 |
| 6,279,670 | B1 | 8/2001 | Eddison et al. | |

(Continued)

OTHER PUBLICATIONS

Response to Office Action from European Patent Application No. 10788373.8 dated Jan. 7, 2013 with amended claims and description attached,17 pages.

(Continued)

*Primary Examiner* — Kenneth L Thompson
(74) *Attorney, Agent, or Firm* — JL Salazar Law Firm

(57) ABSTRACT

A tubular retrieval method involves applying a cyclically varying fluid pressure to the interior of a section of cut bore-lining tubular. The tubular may be casing which it is desired to remove from a bore. A pulling force may also be applied to the tubular.

40 Claims, 2 Drawing Sheets

(56) References Cited

U.S. PATENT DOCUMENTS 6,508,317 B2 1/2003 Eddison et al.
7,077,205 B2 7/2006 Eddison

OTHER PUBLICATIONS

International Search Report dated Aug. 31, 2011 from counterpart PCT Application No. PCT/GB2010/002140, pp. 1-6.

Written Opinion dated May 21, 2012 from counterpart PCT Application No. PCT/GB2010/002140, pp. 1-8.

International Preliminary Report on Patentability dated May 22, 2012 from counterpart PCT Application No. PCT/GB2010/002140, pp. 1-9.

* cited by examiner

TUBULAR RETRIEVAL

FIELD OF THE INVENTION

This invention relates to a method and apparatus for use in retrieving tubulars from bores. Aspects of the invention relate to the retrieval of cut casing from boreholes drilled to access subsurface hydrocarbon-bearing formations.

BACKGROUND OF THE INVENTION

Wells drilled to access subsurface formations may be lined with tubular members, typically metal tubular lengths joined together by threaded connectors. In the oil and gas exploration and production industry, an initial section of the well bore is drilled and then lined with a string of tubular members, known as casing, which extends from the end of the bore to the surface of the earth. Cement may then be circulated into the annulus between the casing and the bore wall. The set cement provides support for the bore wall and prevents fluid migration along the annulus. The drilling of the bore is then continued beyond the end of the first casing. A second casing string is then run into the bore. This string also extends from the end of the bore to surface. Again, cement is circulated into the annulus between the casing string and the bore wall. However, the volume of cement is selected to be sufficient only to fill the annulus between the second string and the surrounding unlined bore wall; the annulus between the first and second casing strings is left substantially free of cement.

This process is repeated until the desired depth is reached, and the upper end of the bore is lined by numerous casing strings, the smallest diameter innermost casing extending from surface to the end of the bore.

At some point in the life of the well, for example prior to abandonment or in the course of workover procedures, it may be desired to remove portions of some of the casing strings. Generally, no attempt is made to retrieve the cemented casing sections. Rather, the innermost casing is cut above the cemented section, and the cut section retrieved. However, this may not be straightforward. Solid material may have gathered or settled in the annulus between the cut casing and the surrounding casing during the life of the well. Also, corrosion between the casings may cause adjacent casings to become fixed relative to one another.

Thus, a typical procedure for retrieving casing may involve the following steps:

- determining the height of the cement in the annulus between the inner casing section to be cut and retrieved and the larger outer casing;
- determining the location of the cut to be made in the inner casing;
- setting a packer below the cut location to seal off the bore of the inner casing;
- cutting the inner casing;
- running a work string into the casing carrying a fishing bottom hole assembly (BHA) comprising a casing spear and a pack-off element;
- setting the casing spear and the pack-off element at the upper end of the casing to be retrieved;
- applying tension to the cut casing via the work string and casing spear; and
- simultaneously applying fluid pressure to the isolated section of the cut casing between the lower packer and the upper pack-off, via the work string, to push or pump the casing free.

If the cut casing does not come free a second cut may be made in the casing, closer to surface.

In anticipation of difficulties in retrieving a cut casing, the operator may incorporate a jar in the fishing BHA. Alternatively, the present applicant's Agitator (Trade Mark) tool may be incorporated in the BHA. As described in U.S. Pat. No. 7,077,205, the disclosure of which is incorporated herein in its entirety by reference, a flow pulsing tool such as the applicant's Agitator tool may be used in conjunction with an extension and retraction means, such as a shock tool, to vary the tensile load applied to a stuck object, such as a cut casing section. Operation of the applicant's Agitator tool, further details of which are described in U.S. Pat. No. 6,279,670, the disclosure of which is also incorporated herein in its entirety by reference, requires circulation of fluid through the tool. Thus, fluid is pumped down the work string, passes through the Agitator tool, and passes though outlet ports in the fishing BHA and into the annulus above the casing spear.

SUMMARY OF THE INVENTION

According to the present invention there is provided a tubular retrieval method including applying a cyclically varying fluid pressure to the interior of a section of cut bore lining tubular.

According to another aspect of the invention there is provided tubular retrieval apparatus comprising:

- at least one seal configurable to isolate a section of cut bore-lining tubular;
- a pressure pulse-generating device configurable to apply pressure pulses to the isolated section of tubing.

The pressure pulses or varying pressure will tend to push the tubular being retrieved free from the surrounding larger diameter tubular. As the pressure pulses are applied to the cut section, the pressure will be applied to a relatively large area; potentially the cross-sectional area of outer tubular surrounding the cut tubular, and at least the cross-sectional area of the cut tubular. The varying pressure may also assist in dislodging solids which have settled or otherwise lodged in the annulus between the cut tubular and the surrounding tubular. Furthermore, the varying pressure may assist in establishing fluid circulation in the annulus, assisting retrieval of the cut tubular.

An upper seal may be configured for location above the cut, and may configured for location towards the upper end of the cut tubular. A lower seal may be configured for location below the cut.

The apparatus may include a support member configurable to engage the cut tubular, typically an upper end of the tubular. The support member may be utilized to apply a pulling force to the tubular, and the support member may be tubular and configured to carry fluid. The support member may include a gripping device to engage the cut tubular, and the gripping device may incorporate or be provided in combination with the upper seal.

The pressure pulse-generating device may be located above the cut tubular. The device may be configured for mounting in a support member engaging the tubular.

The pressure pulse-generating device may take any appropriate form. In one embodiment the device is configured to act on fluid being circulated in the bore above the cut tubular and to generate pressure pulses or pressure variations in the circulating fluid. The fluid may be circulated through a tubular support member and an annulus between the support member and the surrounding tubular. The apparatus may be configurable to provide communication between the circulating fluid and the isolated section of cut tubing, whereby the pressure pulses or pressure variations are applied to fluid in the isolated section.

The pressure pulse-generating device may be fluid actuated, and may be adapted to be actuated by fluid being circulated in the well bore. The device may include a positive displacement motor, such as a Moineau principle motor. The device may include a valve operable to vary a fluid flow area, and thus vary the pressure in fluid being passed through the valve. The valve may be configured to rotate or oscillate. The device may produce a variation on the fluid pressure above or below the valve. The apparatus may be configurable to provide fluid communication between the fluid above the valve and the isolated section of cut tubing. Alternatively, or in addition, the apparatus may be configurable to provide fluid communication between the fluid below the valve and the isolated section of tubing.

The apparatus may be configured to permit fluid to pass from an outlet of the pressure pulse-generating device into an annulus between the device and the surrounding tubular. The fluid may pass from the device outlet to the annulus via a flow port. The flow port may be nozzled or otherwise restricted. The flow port may be configured to be opened and closed. In one embodiment, the pulse-generating device may be deactivated by closing the flow port.

BRIEF DESCRIPTION OF THE DRAWINGS

These and other aspects of the invention will now be described, by way of example, with reference to the accompanying drawings, in which.

DETAILED DESCRIPTION OF THE DRAWINGS

Figure 1:
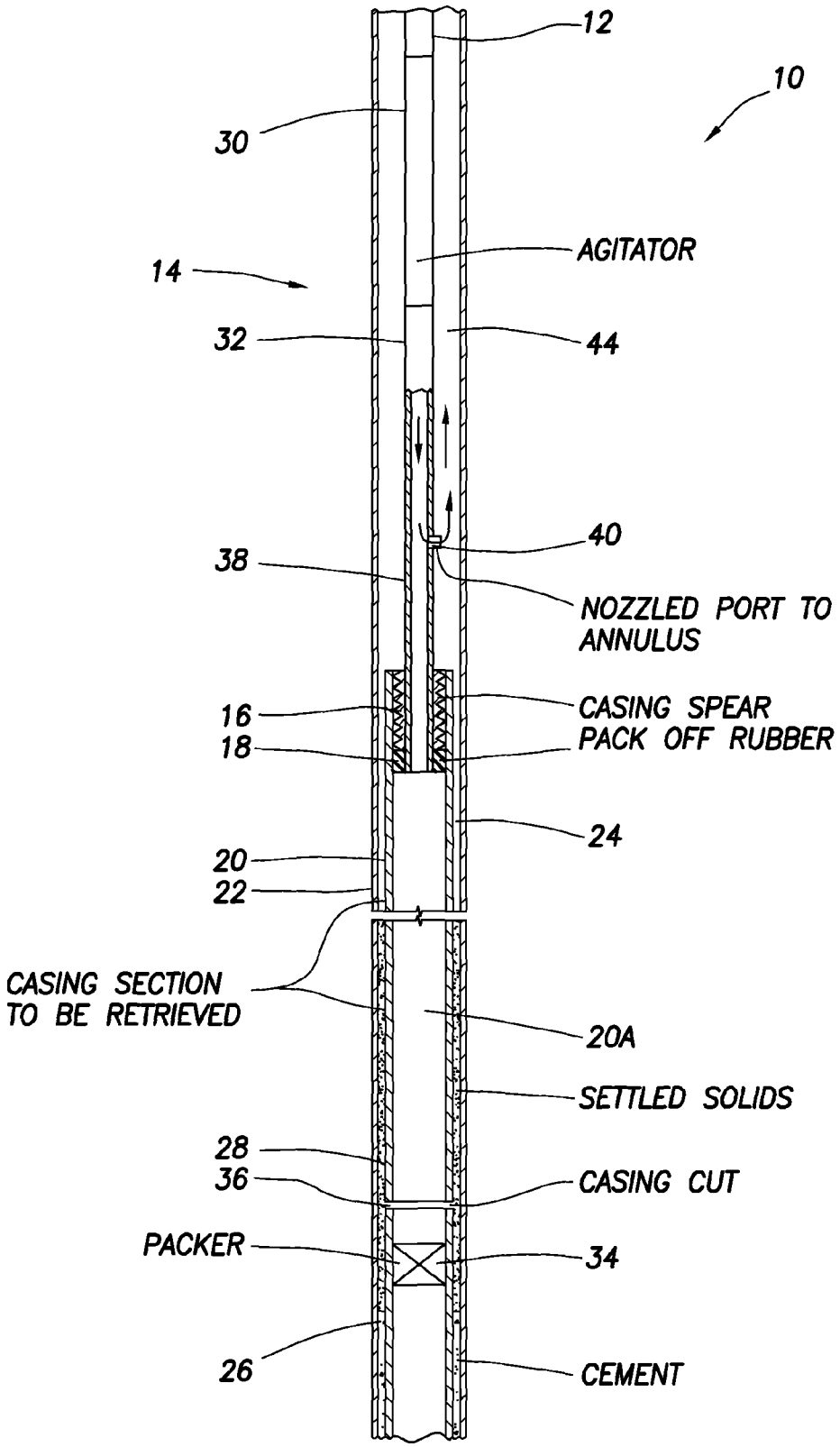
FIG. 1 is a sectional view of tubular retrieval apparatus in accordance with a first embodiment of the present invention.

Reference is first made to FIG. 1 of the drawings, which shows a sectional view of tubular retrieval apparatus 10 in accordance with a first embodiment of the present invention. The apparatus 10 is shown mounted to the lower end of a tubular work string 12. The apparatus 10 forms part of a fishing bottom hole assembly (BHA) 14 which includes a casing spear 16 and a pack-off rubber 18. The fishing BHA 14 thus may be secured and sealed to the upper end of an inner section of casing 20 which it is desired to retrieve.

The inner casing 20 is mounted within an outer casing 22. A lower portion of an annulus 24 between the casings 20, 22 has been filled with cement 26. The upper part of the annulus 24 is free of cement, however over the life of the well the upper end of the inner casing 20 is likely to have become fixed relative to the outer casing 22 through corrosion and the presence of mud solids 28 that have settled between the casing strings.

The apparatus 10 comprises a positive displacement motor section 30 positioned above a valve assembly 32. The positive displacement motor and valve assembly are similar to the motor and valve described in U.S. Pat. No. 6,279,670. Thus, as fluid is passed through the motor 30, a rotor is subject to rotation and also oscillates within the motor stator. The lower end of the rotor provides mounting for an upper valve plate configured to co-operate with a stationary lower valve plate. As the rotor rotates and oscillates, openings in the valve plates are moved into and out of alignment, thus varying the flow area through the valve assembly 32.

The fishing BHA 14 also includes a section of pipe 38 mounted to the lower end of the valve assembly 32 and which extends downwards to provide mounting for the casing spear 16 and pack-off element 18. The pipe 38 provides fluid communication between the outlet of the valve assembly 32 and the isolated section of the inner casing 20A. Also, the pipe 38 defines a nozzled port 40 which provides fluid communication between the pipe 38 and the upper annulus 44 between the work string 12 and the apparatus 10 and the outer casing 22.

In use, an operator wishing to retrieve the inner casing 20 will first determine the height of the cement 26 in the annulus 24 between the casings 20, 22. The operator will then determine where the inner casing should be cut, this normally being a short distance above the upper end of the cement 26. The operator will then set a packer 34 within the inner casing 20, below the location where the cut is to be made. This seals off the bore of the inner casing 20. A cutter (not shown) is then run into the bore to produce a casing cut 36. The work string 12 carrying the fishing BHA 14 is then run in to the bore and the casing spear 16 and pack-off element 18 set at the upper end of the inner casing 20.

Tension is then applied to the work string 12 from surface, which tension is thus applied to the cut section of the inner casing 20. In addition, surface pumps are started and cause fluid to be pumped down the work string 12 and through the fishing BHA 14. The passage of fluid through the motor section 30 causes the rotor to rotate and produces relative movement of the valve plates within the valve assembly 32. Thus, the rotary valve within the valve assembly 32 opens and closes, providing a varying fluid pressure below the valve assembly 32, which varying fluid is applied to the cut section of casing. Initially, it is likely that the settled solids and other material 28 in the annulus 24 will prevent circulation of the fluid from the inner casing 20, through the cut 36, and up through the annulus 24. Accordingly, the pulsing pressure will create an upward force acting over the cross-section of the inner casing 20. There is also a pulsed fluid pressure force acting through the cut 36 and tending to dislodge the settled solids 28. The pressure pulses will also tend to vibrate the casing, further assisting in reducing friction and dislodging the solids 28.

The nozzled port 40 allows fluid circulation and operation of the motor 30 while the annulus 24 remains blocked above the cut 36, the nozzling of the port 40 maintaining a back pressure within the cut section of casing.

In due course the cut section of casing will break free, and at some point it is likely that the pulsing fluid pressure will dislodge the solids 28 to achieve circulation through the annulus 24, which will facilitate movement of the inner casing 20 relative to the outer casing 22.

Once the inner casing 20 has been freed from the outer casing 22, retrieval is relatively straightforward.

In an alternative arrangement, the nozzled port 40 incorporates a valve which may be opened and closed from surface by the operator. When closed, the valve prevents flow through the port 40. Thus, if the valve is closed and the annulus 24 above the cut 36 is blocked, there is no circulation route for fluid being pumped from surface. In this situation the motor 30 will not operate, although fluid pressure may still be transmitted through the motor 30 to the cut section of casing below the apparatus 10. Accordingly, it is possible for the operator to turn the apparatus on and off by opening and closing the valve.

Figure 2:
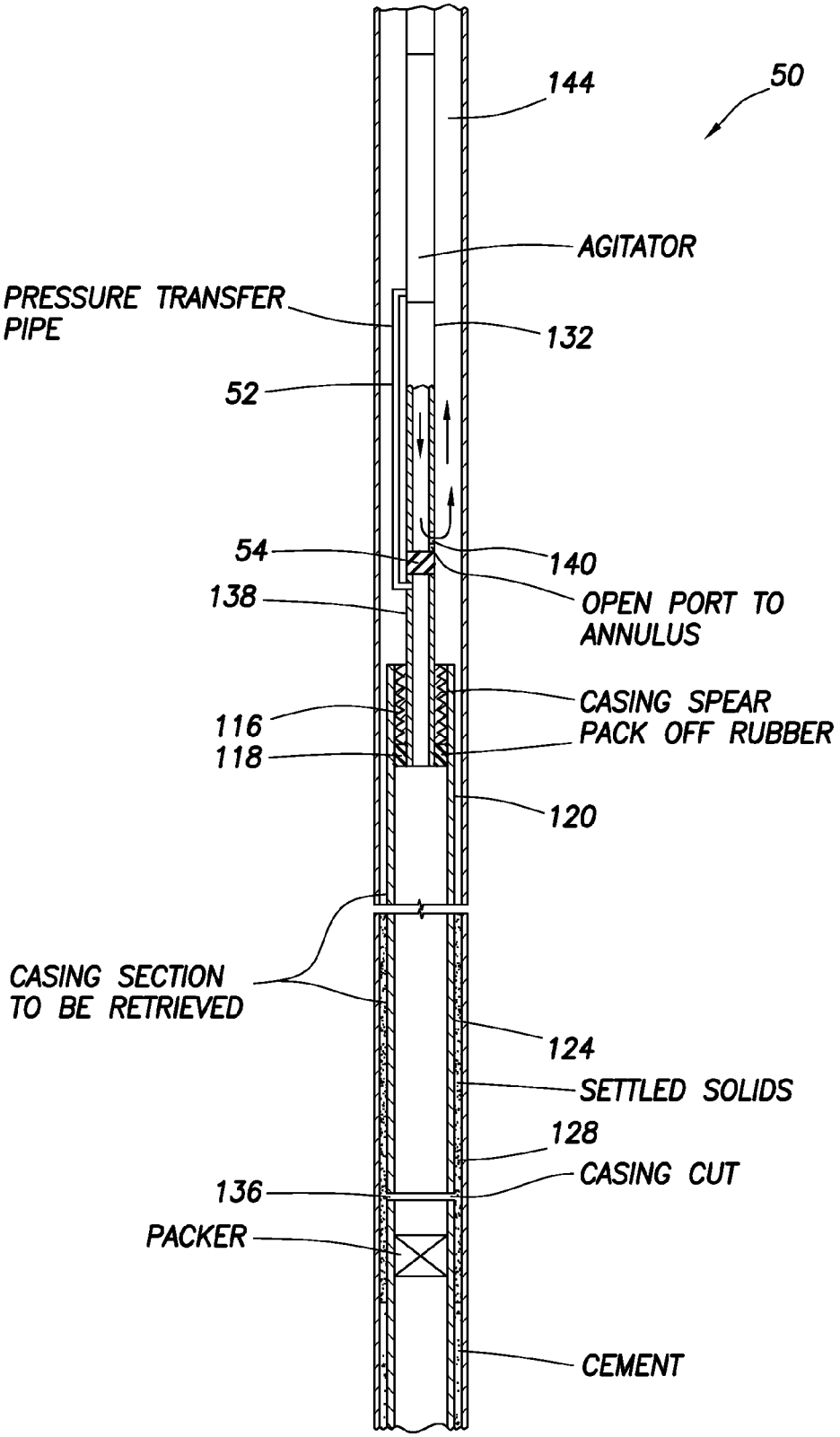
FIG. 2 is a sectional view of tubular retrieval apparatus in accordance with a second embodiment of the present invention.

Reference is now made to FIG. 2 of the drawings, which illustrates tubular retrieval apparatus 50 in accordance with a second embodiment of the present invention. Many details of the construction and use of the apparatus 50 are similar to the apparatus 10 described above, and those elements will not be described again in detail.

In the illustrated arrangement, there is again an outlet port 140 provided below the valve assembly 132, however the port 140 is not nozzled, allowing relatively free flow to the upper annulus 144. However, a pressure transfer pipe 52 extends from above the valve assembly 132 to a point in the pipe 138 above the casing spear and pack-off element 116, 118. The point where the pressure transfer pipe 52 enters the pipe 138 is isolated from the port 140 by a seal 54.

During operation of the apparatus 50, the pressure pulses generated above the valve assembly 132 are transferred through the pipe 52 and the casing spear 116 to the cut section of inner casing 120.

Use of the apparatus 50 is otherwise similar to the apparatus 10 described above. However, the apparatus 50 offers the additional advantage that there is no requirement to elevate the back pressure downstream of the valve assembly 132 (achieved by nozzling the port 40 in the first embodiment), which increases the surface pump requirements.

It will be apparent to those of skill in the art that the above described arrangements allow an operator to introduce pressure pulses below the casing spears 16, 116 and act on the full area of the casing string 20, 120. Also, the pulses below the spears 16, 116 assist in directly pushing the casing 20, 120 free. Furthermore, applying pressure pulses through the casing cut 36, 136 will assist in dislodging solids 28, 128 in the annulus 24, 124 in order to establish circulation and free the inner casing 20, 120.

It will be apparent to those of skill in the art that the above described embodiments are merely exemplary of the present invention, and that various modification and improvements may be made thereto, without departing from the scope of the invention.

What is claimed is:

1. A tubular retrieval method, comprising:

applying a cyclically varying fluid pressure to an interior of a section of a cut tubular lining a bore and having a cut;

circulating fluid in the bore above the cut tubular and generating pressure pulses or pressure variations in the circulating fluid; and providing fluid communication between the circulating fluid and an isolated section of the cut, whereby the pressure pulses or pressure variations are applied to fluid in the isolated section.

2. The method of claim 1, further comprising establishing a seal across the cut tubular above the cut.

3. The method of claim 1, further comprising establishing a seal across the tubular above the cut and towards an upper end of the cut tubular.

4. The method of claim 1, further comprising establishing a seal across the cut tubular below the cut.

5. The method of claim 1, further comprising applying a pulling force to the cut tubular.

6. The method of claim 1, further comprising engaging the cut tubular with a support member above the cut and applying a pulling force to the cut tubular.

7. The method of claim 6, further comprising passing fluid through the support member.

8. The method of claim 1, further comprising providing a pressure pulse-generating device above the cut tubular.

9. The method of claim 8, further comprising mounting the pressure pulse-generating device in a support member engaging the cut tubular.

10. The method of claim 1, further comprising actuating a pressure pulse-generating device with a circulating fluid.

11. The method of claim 1, further comprising generating pressure pulses in a circulating fluid by operating a valve and providing fluid communication between the circulating fluid above the valve and an isolated section of the cut tubing.

12. The method of claim 1, further comprising generating pressure pulses in a circulating fluid by operating a valve and providing fluid communication between the circulating fluid below the valve and an isolated section of the cut tubular.

13. The method of claim 1, further comprising permitting fluid to pass from an outlet of a pressure pulse-generating device into an annulus between the device and a surrounding tubular.

14. The method of claim 13, wherein the fluid is passed through from the outlet of the device to the annulus via a restricted flow port.

15. The method of claim 1, wherein the varying fluid pressure pushes the cut tubular being retrieved free from a larger diameter tubular surrounding the cut tubular.

16. The method of claim 1, wherein the varying fluid pressure is applied to at least a cross-sectional area of the cut tubular.

17. The method of claim 16, wherein the varying fluid pressure is applied to the cross-sectional area of a larger diameter tubular surrounding the cut tubular.

18. The method of claim 1, wherein the varying fluid pressure dislodges solids in an annulus between the cut tubular a larger diameter tubular surrounding the cut tubular.

19. A tubular retrieval apparatus, comprising:

at least one seal positionable to isolate a section of a cut tubular lining a bore and having a cut;

a pressure pulse-generating device applying fluid pressure pulses to an isolated section of the cut tubular; and a support member engagable with the cut tubular, wherein the support member includes a gripping device to engage the cut tubular.

20. The apparatus of claim 19, further comprising an upper seal locatable above the cut.

21. The apparatus of claim 20, wherein the upper seal is locatable towards an upper end of the cut tubular.

22. The apparatus of claim 19, further comprising a lower seal locatable below the cut.

23. The apparatus of claim 19, wherein the support member applies a pulling force to the cut tubular.

24. The apparatus of claim 19, wherein the support member is tubular and carries fluid.

25. The apparatus of claim 19, wherein the gripping device is provided on the support member in combination with an upper seal.

26. The apparatus of claim 19, wherein the pressure pulse-generating device is mountable in a support member engaging the cut tubular.

27. The apparatus of claim 19, wherein the pressure pulse-generating device acts on fluid being circulated in the bore above the cut tubular and generates pressure pulses or pressure variations in circulating fluid.

28. The apparatus of claim 27, wherein the apparatus provides communication between the circulating fluid and an isolated section of the cut tubular, whereby the pressure pulses or pressure variations are applied to fluid in the isolated section.

29. The apparatus of claim 19, wherein the pulse-generating device includes a valve operable to vary a fluid flow area, and thereby vary pressure in fluid being passed through the valve.

30. The apparatus of claim 29, wherein the valve is rotatable or oscillatable.

31. The apparatus of claim 29, wherein the pulse-generating device produces a variation in fluid pressure above or below the valve.

32. The apparatus of claim 31, wherein the apparatus provides fluid communication between the fluid above the valve and the isolated section of cut tubular.

33. The apparatus of claim 31, wherein the apparatus provides fluid communication between the fluid below the valve and the isolated section of tubular.

34. A tubular retrieval apparatus, comprising:

at least one seal positionable to isolate a section of a cut tubular lining a bore and having a cut;

a pressure pulse-generating device applying fluid pressure pulses to an isolated section of the cut tubular; wherein the pressure pulse-generating device is actuatable by fluid being circulated in the bore.

35. The apparatus of claim 34, wherein the pulse-generating device comprises a positive displacement motor.

36. A tubular retrieval apparatus, comprising:

at least one seal positionable to isolate a section of a cut tubular lining a bore and having a cut;

a pressure pulse-generating device applying fluid pressure pulses to an isolated section of the cut tubular; and wherein the apparatus permits fluid to pass through a port from an outlet of the pressure pulse-generating device into an annulus between the device and the surrounding cut tubular.

37. The apparatus of claim 36, comprising a nozzled flow port through which the fluid passes from the device outlet to the annulus.

38. The apparatus of claim 36, wherein the port opens and closes.

39. The apparatus of claim 36, wherein the pulse-generating device is de-activatable by closing a flow port.

40. A tubular retrieval method, comprising:

applying a cyclically varying fluid pressure to an interior of a section of a cut tubular lining a bore and having a cut; wherein the cyclically varying fluid pressure establishes fluid circulation in an annulus between the cut tubular and a larger diameter tubular surrounding the cut tubular.

* * * * *